US010695839B2

(12) United States Patent
Gries et al.

(10) Patent No.: US 10,695,839 B2
(45) **Date of Patent: *Jun. 30, 2020**

(54) METHOD FOR PRODUCING SPRAY POWDERS CONTAINING CHROMIUM NITRIDE

(71) Applicant: H.C. STARCK SURFACE TECHNOLOGY AND CERAMIC POWDERS GMBH, Munich (DE)

(72) Inventors: Benno Gries, Wolfenbuettel (DE); Bernhard Bruening, Bad Harzburg (DE)

(73) Assignee: H.H. STARCK SURFACE TECHNOLOGY AND CERAMIC POWDERS GMBH, Munich (DE)

( * ) Notice: Subject to any disclaimer, the term of this patent is extended or adjusted under 35 U.S.C. 154(b) by 81 days.

This patent is subject to a terminal disclaimer.

(21) Appl. No.: 14/761,006

(22) PCT Filed: Jan. 23, 2014

(86) PCT No.: PCT/EP2014/051324

§ 371 (c)(1),
(2) Date: Jul. 15, 2015

(87) PCT Pub. No.: WO2014/114714

PCT Pub. Date: Jul. 31, 2014

(65) Prior Publication Data

US 2016/0001368 A1 Jan. 7, 2016

Related U.S. Application Data

(60) Provisional application No. 61/756,475, filed on Jan. 25, 2013.

(30) Foreign Application Priority Data

Jan. 24, 2013 (DE) ..... 10 2013 201 104

(51) Int. Cl.

| | |
|---|---|
| ***B22F 9/02*** | (2006.01) |
| ***C22C 32/00*** | (2006.01) |
| ***C22C 29/16*** | (2006.01) |
| ***B22F 1/00*** | (2006.01) |
| ***C22C 1/05*** | (2006.01) |
| ***C22C 30/00*** | (2006.01) |
| ***C23C 4/10*** | (2016.01) |
| *B22F 5/02* | (2006.01) |

(52) U.S. Cl.

CPC ..... *B22F 9/02* (2013.01); *B22F 1/0085* (2013.01); *B22F 1/0096* (2013.01); *C22C 1/056* (2013.01); *C22C 29/16* (2013.01); *C22C 30/00* (2013.01); *C22C 32/0068* (2013.01); *C23C 4/10* (2013.01); *B22F 5/02* (2013.01); *B22F 2201/02* (2013.01)

(58) Field of Classification Search

CPC ..... B22F 9/02; B22F 1/0085; B22F 1/0096; C22C 1/056; C22C 29/16; C22C 32/0068; C22C 30/00; C23C 4/10

See application file for complete search history.

(56) References Cited

U.S. PATENT DOCUMENTS

| | | | |
|---|---|---|---|
| 4,623,402 | A | 11/1986 | Maximov et al. |
| 2004/0037969 | A1 | 2/2004 | Smith et al. |
| 2006/0040125 | A1 | 2/2006 | Obara et al. |
| 2008/0105083 | A1 | 5/2008 | Nakamura et al. |
| 2010/0189910 | A1 | 7/2010 | Belashchenko |
| 2011/0076587 | A1 | 3/2011 | Wang et al. |
| 2012/0082586 | A1 | 4/2012 | Moyer |

FOREIGN PATENT DOCUMENTS

| | | | | |
|---|---|---|---|---|
| CN | 1705765 | A | 12/2005 | |
| CN | 1854104 | A | 11/2006 | |
| CN | 101979701 | A | 2/2011 | |
| CN | 102639744 | A | 8/2012 | |
| DE | 10 2008 056 720 | B3 | 5/2010 | |
| EP | 1 564 309 | A1 | 8/2005 | |
| JP | 07-252501 | * | 3/1995 | ..... B22F 1/00 |
| SU | 1763503 | A1 | 9/1992 | |
| TW | 200829351 | A | 7/2008 | |

OTHER PUBLICATIONS

Machine translation of JP 07-252501. Mar. 1995.*

DIN EN 1274 :"Thermal spraying—Powders: Composition, technical supply conditions", English version of DIN EN 1274, pp. 1-20 (2005).

* cited by examiner

*Primary Examiner* — John E Uselding

(74) *Attorney, Agent, or Firm* — Norman B. Thot

(57) ABSTRACT

A process for producing a sintered spraying powder comprising chromium nitride includes producing a powder mixture comprising a first powder and a second powder, and sintering the powder mixture to the sintered spraying powder at a nitrogen partial pressure of >1 bar so as to maintain or increase a chemically bound nitrogen in the sintered spraying powder compared to a chemically bound nitrogen in the first powder mixture. The first powder comprises at least one constituent selected from the group consisting of Cr, CrN and $Cr_2N$. The second powder comprises at least one constituent selected from the group consisting of nickel, cobalt, nickel alloys, cobalt alloys and iron alloys.

24 Claims, No Drawings

METHOD FOR PRODUCING SPRAY POWDERS CONTAINING CHROMIUM NITRIDE

CROSS REFERENCE TO PRIOR APPLICATIONS

This application is a U.S. National Phase application under 35 U.S.C. § 371 of International Application No. PCT/EP2014/051324, filed on Jan. 23, 2014 and which claims benefit to German Patent Application No. 10 2013 201 104.0, filed on Jan. 24, 2013, and to U.S. Provisional Patent Application No. 61/756,475, filed on Jan. 25, 2013. The International Application was published in German on Jul. 31, 2014 as WO 2014/114714 A1 under PCT Article 21(2).

FIELD

The present invention relates to a process for producing chromium nitride-containing sintered spraying powders. Such sintered spraying powders can be used for coating wear parts, construction components, or tools by thermal spraying. The spraying powder produced via the process of the present invention can in particular be used for the surface coating of wear parts, construction components, and tools in the case of highly stressed friction pairings when these friction pairings tend to undergo frictional welding or microwelding, for example, in the case of internal combustion engines, piston compressors, piston machines, or piston rods.

BACKGROUND

Wear frequently determines the life of a component. Optimizations within a tribological system therefore directly increase the life and thus reduce costs for the user. Components of this type are provided with coatings in order to improve the tribological and wear properties. Coatings display, in a manner analogous to massive materials, various properties which can be determined empirically. These include, for example, hardness, wear resistance, and corrosion behavior in various media. In many applications, however, the frictional behavior of coatings opposite a second friction partner plays a particular role. These are, for example, coated piston rods which run in a guide sheath made of steel or cast iron. The behavior of the friction pairing "coating/friction partner" is of predominant importance in, for example, (internal) combustion engines where coated piston rings run in a bushing made of, for example, grey cast iron or AlSi alloys. In such applications, CrN has in particular been found to be particularly useful. Coatings composed of or containing CrN are therefore widely applied by PVD (physical vapor deposition) to piston rings for (internal) combustion engines, piston compressors and similar piston machines, and also to extruder screws and similar components. Such layers allow good running performance with minimal wear and are now widely established in the motor vehicle sector. A disadvantage is, however, a high capital outlay for plant engineering, which is economical only in the case of large numbers and of small components. In the case of larger components or thicker layers, CrN has hitherto not been applied economically by means of PVD. Stresses caused by different coefficients of thermal expansion of substrate and layer material build up in PVD layers also increases with increasing layer thickness. Such stresses lead to crack formation through to detachment of the layer.

This results in insufficient wear reserves being present because the layer thickness is too low for many applications in highly stressed friction pairings. Coatings produced by means of PVD have low roughnesses of less than 10 μm, which is very advantageous for friction pairings. Thermal spraying is an alternative to PVD. Thermal spraying powders are used to produce coatings on substrates. Pulverulent particles are here introduced into a combustion flame or plasma flame which is directed at the (usually metallic) substrate which is to be coated. The particles melt completely or partly in the flame, impinge on the substrate, solidify there, and form the coating in the form of solidified "splats". Coatings produced by thermal spraying can have a layer thickness up to several 100 μm and often consist of one or more usually ceramic and/or metallic component(s). The metallic component is here able to dissipate thermally induced stresses (residual stress) in the layer by plastic flow, while the ceramic hard phase produces the necessary wear resistance of the layer. Thermally sprayed layers also often have porosities which is advantageous for dissipating stresses.

Wear surfaces having tribologically adjusted friction pairings, in particular piston rings and piston rods, are thermally coated in industry with thermal spraying powders based on molybdenum carbide or chromium carbide in combination with metals and alloys such as nickel, molybdenum, nickel-chromium ("thermal spraying"). This makes it possible to produce layers having a thickness of up to a few 100 μm. Such layers and the spraying powders used consist in each case of at least one metallic component (e.g., NiCrBSi alloy, molybdenum) and a hardness carrier which modulates the wear of the piston ring (e.g., chromium carbides and/or molybdenum carbides).

The intrinsic hardness of these hardness carriers must, however, not be too high since the cylinder surface is otherwise cut. For this reason, hard materials having a high intrinsic hardness, e.g., titanium carbide or tungsten carbide, are not used. It is usual to use carbides which have an intrinsic hardness of less than 2000 HV, e.g., Cr carbides and Mo carbides, as hardness carriers. The latter has an intrinsic hardness of 1900 HV ($Mo_2C$). The particle size of these hardness carriers is preferably as small as possible so as to polish, and not cut, the cylinder surface. This also applies to any additional oxides present, e.g., chromium oxide or aluminum oxide.

Thermal spraying powders comprising hardness carriers can be produced in various ways.

Agglomerated and subsequently intrinsically sintered (sintered together in itself) spraying powders are produced by dispersing (disperging) pulverulent hardness carriers together with metallic binder alloys in powder form (for example Ni or Ni-based alloy powders) in a liquid and then carrying out a granulation step by separating off the liquid, for example, by spray drying. This gives particles which consist of an agglomerated mixture of the powders used. These agglomerates have a mechanical strength which is typically unsuitable for modern spraying processes such as HVOF ("High Velocity Oxygen Fuel") since these require mechanically stable agglomerates because of the high flame velocities. The spray-dried granulate (granules) is subsequently optionally screened (classified/sized) and intrinsically sintered in a subsequent thermal process step to such an extent that the granulate has a mechanical strength which is sufficient for it not to disintegrate (collapse/degrade) during the thermal spraying process, e.g., by means of HVOF. The thermal process step ("sintering") is usually carried out either under reduced pressure or under a protective gas which avoids oxidation in the vicinity of atmospheric pressure, usually hydrogen, optionally with proportions of argon and/or other noble gases. This gives a powder or a loosely sintered cake which can easily be converted back into powder, in this case, the spraying powder. The powders obtained are similar in size and appearance to the spray-dried granulate. This intrinsically sintered agglomerate will hereinafter be referred to as "sintered agglomerate". It is therefore customary in industry to speak of "agglomerated/sintered spraying powders" and of "agglomerated/sintered powders". The typical internal structure of such agglomerated/sintered spraying powders can be seen from Fig. A.1 in DIN EN 1274 (February 2005). The two powder components (hard material and metallic matrix) can clearly be seen. Agglomerated/sintered spraying powders are particularly advantageous since they offer great freedom in the choice of the components (for example, their contents and particle sizes) and can be readily metered in the spraying process because of their good flowability. It is in particular possible to use very fine hardness carriers which in use leads to very smooth wear surfaces, which in turn leads to low coefficients of friction and high operating lives during use of the friction surface. The particle size of the pulverulent hardness carriers is typically below 10 μm. Particularly finely divided carbides are obtained by reacting metallic components with carbon during sintering, as is practiced in the case of Mo- and NiCr-containing spraying powders.

Sintered and subsequently crushed spraying powders ("sintered/crushed spraying powders") are produced in a manner analogous to agglomerated/sintered spraying powders, with the difference that the powder components are not necessarily mixed wet in dispersion but can be dry mixed and optionally tableted or compacted to form shaped bodies. The subsequent sintering is carried out analogously, but the temperature and/or any precompaction is effected in such a way that compact, solid sintered bodies are obtained and must be converted back into powder form by action of mechanical force. The powders obtained are therefore irregular in shape and characterized by fracture phenomena on the surface. They also typically have no, or barely any, internal porosity as is typical in the case of agglomerated/sintered spraying powders. Fig. A.6 of DIN EN 1274 (February 2005) shows the typical structure of sintered/crushed spraying powders. The starting powders can barely be discerned. These spraying powders display significantly poorer flowability, which is disadvantageous for a constant application rate during thermal spraying, but is often still practicable.

"Cladded" spraying powders are obtained when the pulverulent hardness carrier is coated with the metallic component by means of electrolytic or electroless deposition. For example, the hardness carrier can be dispersed in pulverulent form in a nickel salt solution, whereupon a shell having a thickness of a few μm is deposited on it by means of electrolytic or chemical reduction. However, this process can be carried out only above a particle size of the hardness carrier of about 10 μm since otherwise, due to the small radii of curvature on the surface of the hardness carrier, the nucleation energies required for fresh formation of the metallic phase increase too greatly and a shell is no longer obtained. The layers obtained after thermal spraying therefore contain relatively coarse hard material particles and thus hardness carriers projecting from the layer surface, which is disadvantageous for a very smooth wear surface. Fig. A.2 of EN 1274 (February 2005) shows the typical shape of a metal-cladded hard material.

A further embodiment of spraying powders composed of a plurality of different powders are "blends". These are a simple mixture of powders which is then used for coating. However, in the case of modern coating processes, such as the HVOF process, demixing (segregation) of the powder components usually occurs as a result of the high flow velocity and the turbulences, and the composition of the layer therefore no longer corresponds to the composition of the blend.

Hardness carriers which are of particular interest for friction coatings are nitrides. They generally have lower intrinsic hardnesses than the corresponding carbides or even borides. TiN thus has a hardness of 2450 kg/mm$^2$ (for comparison: TiC 3200 kg/mm$^2$). For example, chromium carbides have intrinsic hardnesses in the range from 1880 kg/mm$^2$ ($Cr_7C_3$) and 1663 kg/mm$^2$ ($Cr_{23}C_6$), whereas $Cr_2N$ has a hardness of 1591 kg/mm$^2$, and CrN a hardness of only 1093 kg/mm$^2$. It is clear from this why pure CrN has become established as coating material for piston rings. While $Cr_2N$ has an intrinsic hardness of the same order of magnitude as chromium carbides, and is thus tribologically suitable for friction pairings, CrN has a lower intrinsic hardness. The far higher hardnesses measured for PVD coatings are due to residual stresses and the particular substructure of the coating and must not be compared with the hardnesses determined on crystallites ("intrinsic hardnesses").

Chromium nitrides also have excellent resistance to frictional wear and, due to their pronounced chemical inertness, are insensitive to microwelding phenomena which must be avoided in many uses because of the resulting adhesion wear.

It would therefore be desirable to have agglomerated/sintered spraying powders having a metallic component such as nickel and containing chromium nitrides as hardness carriers. These would make it possible to produce thicker layers which would have sufficient wear reserves.

Agglomerated/sintered spraying powders or sintered/crushed spraying powders (in the present disclosure described collectively as "sintered spraying powders"), in particular ones containing CrN, have hitherto not been described. The reason therefor is that decomposition of the CrN into $Cr_2N$, from $Cr_2N$ to metallic chromium and, depending on the presence of carbon during sintering, also a further reaction to form Cr carbides, whose intrinsic hardnesses are all higher, occurs during sintering of chromium nitride-containing granulates or powder mixtures. Owing to the rapidity of the spraying process and the splitting-off of the nitrogen being slower compared to heat transport due to diffusive transport, it can be assumed that sintered spraying powders could also produce chromium nitride-containing coatings if sintered spraying powders of this type could be produced.

Owing to the high melting points in the production of atomized spraying powders, the nitrogen content necessary for formation of significant contents of chromium nitrides cannot be obtained in the melt since the solubility of nitrogen therein is too low.

A further possible way of producing chromium nitride-containing coatings is the use of powder mixtures ("blends"), for example, mixtures of Ni or NiCr powder with chromium nitrides and optionally other hardness carriers. A disadvantage is, however, that comparatively coarse hardness carriers must be used in order that the oxidation thereof is sufficiently slow during thermal spraying and sufficient kinetic energy is present on impingement. Typical particle sizes for hardness carriers and matrix metal are in this case from 10 to 100 μm. Layers produced in this way accordingly have high roughnesses and a poor distribution of hardness carriers in the metallic matrix. Blends are therefore not alternatives.

DE 10 2008 056 720 B3 describes the production of a sprayed layer, which serves as sliding element in an (internal) combustion engine, from chromium nitride-containing spraying powders, whose production process is not disclosed. The sliding layer has a nominal composition of from 10 to 30% of Ni, from 0.1 to 5% of carbon, from 10 to 20% of nitrogen, and from 40 to 79.9% of chromium. The spraying powder which is described in the working example and whose production method is unknown had a nominal composition of 60% of CrN, 10% of $Cr_3C_2$, 25% of Ni, and 5% of Cr. The homogeneous distribution of the carbides (i.e., the 10% of $Cr_3C_2$ contained in the spraying powder) in the sprayed layer is described. The size and distribution of the CrN is likewise not disclosed. The CrN used led, in the elemental analysis, to only 11% of nitrogen instead of the theoretically to be expected 12.72%. It can therefore be deduced that the chromium nitride component described as "CrN" cannot be pure CrN since otherwise a nitrogen content of 12.7% would be expected in the elemental analysis. It can be calculated from the indicated 11% of nitrogen that the chromium nitride component present to an extent of 60% in the spraying powder consisted of only 41% of CrN containing 21.2% of N and of 19% of $Cr_2N$ containing 12.1% of N, i.e., it consisted of 68.3% of CrN and 31.7% of $Cr_2N$. According to the disclosure, the wear properties of the CrN PVD coating were therefore presumably not achieved (Table 1 of DE 10 2008 056 720 B3). The powder disclosed also contains chromium carbides, which can be seen from the material system disclosed, the structural micrographs of the sprayed layer ("homogeneously distributed carbides") and the elemental analysis. Owing to the high intrinsic hardness of the chromium carbides, the chromium nitride-based sliding coating cannot display its full potential and is not comparable in terms of performance with the CrN coating produced by means of PVD.

SUMMARY

An aspect of the present invention is to provide a solution for the abovementioned prior art problems. An aspect of the present invention is in particular to provide a process for producing chromium nitride-containing, in particular CrN-containing, sintered spraying powders which have a sufficient agglomerate strength for the spraying process.

In an embodiment, the present invention provides a process for producing a sintered spraying powder comprising chromium nitride which includes producing a powder mixture comprising a first powder and a second powder, and sintering the powder mixture to the sintered spraying powder at a nitrogen partial pressure of >1 bar so as to maintain or increase a chemically bound nitrogen in the sintered spraying powder compared to a chemically bound nitrogen in the first powder mixture. The first powder comprises at least one constituent selected from the group consisting of Cr, CrN and Cr2N. The second powder comprises at least one constituent selected from the group consisting of nickel, cobalt, nickel alloys, cobalt alloys and iron alloys

DETAILED DESCRIPTION

In an embodiment, the present invention provides for production of an agglomerate of chromium or CrN or $Cr_2N$ with a metallic binder alloy and subsequent sintering in a nitrogen atmosphere under superatmospheric pressure (overpressure/excess pressure) in which Cr can react to form chromium nitrides or $Cr_2N$ can react to form CrN or the chromium nitrides can be at least retained.

The present invention provides a process for producing chromium nitride-containing sintered spraying powder, which comprises the following steps:

a) production of a powder mixture (A) comprising, i) a powder (B) comprising one or more constituents selected from the group consisting of Cr, CrN and $Cr_2N$, and ii) a powder (C) comprising one or more constituents selected from the group consisting of nickel, cobalt, nickel alloys, cobalt alloys and iron alloys; and b) sintering of the powder mixture (A) in a gas atmosphere which contains nitrogen, with the nitrogen chemically bound in the form of chromium nitrides increasing or being at least maintained during the sintering and the nitrogen partial pressure during sintering being above 1 bar.

The present invention further provides a process for producing CrN-containing sintered spraying powder, which comprises the following steps:

a) production of a powder mixture (A) comprising, i) a powder (B) comprising one or more constituents selected from the group consisting of Cr, CrN and $Cr_2N$, and ii) a powder (C) comprising one or more constituents selected from the group consisting of nickel, cobalt, nickel alloys, cobalt alloys and iron alloys; and b) sintering of the powder mixture (A) at a nitrogen partial pressure of greater than 1 bar, with maintenance of or an increase in the chemically bound nitrogen compared to the powder mixture (A).

The present invention further provides a process for producing CrN-containing sintered spraying powder, which comprises the following steps:

a) production of a powder mixture (A) comprising, i) a powder (B) comprising one or more constituents selected from the group consisting of Cr, CrN and $Cr_2N$, and ii) a powder (C) comprising one or more constituents selected from the group consisting of nickel, cobalt, nickel alloys, cobalt alloys and iron alloys; and b) sintering of the powder mixture (A) in a gas atmosphere which contains nitrogen, with the content of nitrogen chemically bound in the form of chromium nitrides increasing or being at least maintained, based on the powder mixture before sintering.

Unless indicated otherwise, the percentages indicated are in percent by weight.

The process of the present invention for producing chromium nitride-containing sintered spray powder comprises, in a first step a), production of a powder mixture (A) comprising a powder (B) and a powder (C).

The powder (B) comprises one or more constituents selected from the group consisting of chromium, CrN and $Cr_2N$. The powder (B) can, for example, comprise mixtures of CrN and $Cr_2N$. The weight ratio of CrN to $Cr_2N$ can vary within a wide range, examples include a weight ratio of from 1:100 to 100:1, for example, from 1:10 to 10:1, for example, from 1:8 to 1:1 and, for example, from 1:6 to 1:2.

In an embodiment of the present invention, the powder (B) can, for example, comprise chromium nitrides (CrN and $Cr_2N$) in an amount of at least 70% by weight, for example, at least 80% by weight, for example, at least 90% by weight, for example, at least 95% by weight, and the powder (B) can, for example, consist of chromium nitrides.

The powder (B) can, however, also consist exclusively of chromium or else of CrN or $Cr_2N$. Powder B can be produced not only by mixing phase-pure CrN and $Cr_2N$ powders, but it can also be a multiphase powder which, according to X-ray diffraction analysis, contains both CrN and $Cr_2N$ in a powder particle. Such a multiphase powder can also consist of metallic chromium and $Cr_2N$, possibly even metallic chromium, $Cr_2N$, and CrN, and possibly also further chromium nitrides which have not yet been found.

Particularly for uses in which the spraying powder obtained by means of the process of the present invention is to be used for coating friction surfaces having a low roughness, it has been found to be advantageous to make the particle size of the powder (B) as small as possible. In an embodiment, the powder (B) can, for example, have a particle size D50 of below 20 μm, for example, below 15 μm. In an embodiment, the D50 of the powder (B) can, for example, be in the range from 0.5 to 10 μm. The D50 here is the volumetric diameter and is measured by means of laser light scattering. D50 means that 50% of the particles have diameters smaller than the value indicated.

In an embodiment of the present invention, the powder (B) can, for example, have a particle size D90 of below 20 μm, for example, below 15 μm.

The powder mixture (A) usually comprises the powder (B) in an amount of from 50 to 90% by weight, for example, from 60 to 80% by weight, in each case based on the total weight of the powder mixture (A).

The powder (C) comprises one or more constituents selected from the group consisting of nickel, cobalt, nickel alloys (alloys which contain nickel, i.e., in particular, including nickel-based alloys), cobalt alloys (alloys which contain cobalt, i.e., in particular, including cobalt-based alloys), and iron alloys (alloys which contain iron, i.e., in particular, including iron-based alloys).

The powder (C) serves as metal matrix (binder metal) for the chromium nitrides which act as hard materials.

In an embodiment of the present invention, the powder mixture (A) can, for example, comprise a cobalt base alloy or nickel base alloy or iron base alloy. The base alloy can contain one or more constituents selected from the group consisting of Cr, Si, Mo, Ti, Ta, B, Y, W and Mn. The alloy can optionally comprise up to 25% by weight of these constituents.

Depending on the sintering conditions selected, one or more of the abovementioned constituent(s) may be nitrided.

In an embodiment of the process of the present invention, the powder mixture (A) can, for example, comprise a nickel powder and/or a nickel-chromium alloy powder.

In an embodiment of the present invention, the powder (C) can, for example, comprise one or more constituents selected from the group consisting of nickel, cobalt, nickel alloys, cobalt alloys and iron alloys in an amount of 50% by weight, for example, 60% by weight, for example, 75% by weight, for example, 85% by weight, and, for example, at least 95% by weight, based on the total weight of the powder (C). In an embodiment, the powder (C) can, for example, consist of one or more constituents selected from the group consisting of nickel, cobalt, nickel alloys, cobalt alloys and iron alloys.

Nickel powders and nickel-based alloy powders, for example, nickel-chromium alloy powder, have been found to be particularly suitable metal matrix materials for chromium nitride-containing sintered spraying powders, but Co powders and Fe-based alloys are also particularly useful when they are alloyed with Cr, Si, Mo and Mn. In an embodiment of the present invention, the powder (C) can, for example, contain at least 50% by weight of a nickel powder and/or nickel-chromium alloy powder, for example, up to 75% by weight, for example, up to at least 95% by weight, based on the total weight of the powder (C), and the powder mixture (C) particularly consists of a nickel powder and/or a nickel-chromium alloy powder.

The powder mixture (A) usually comprises the powder (C) in an amount of from 10 to 50% by weight, for example, from 15 to 45% by weight, and, for example, from 20 to 40% by weight, in each case based on the total weight of the powder mixture (A).

The powder mixture (A) advantageously comprises CrN and/or chromium and/or $Cr_2N$ and, for example, a nickel powder and/or nickel-chromium alloy powder.

In an embodiment of the present invention, the powder mixture (A) can, for example, comprise a cobalt base alloy or nickel base alloy or iron base alloy, where the alloy optionally contains one or more constituents, in particular constituents selected from the group consisting of Cr, Si, Mo, Ti, Ta, B, Y, W and Mn.

Owing to their hardness, the presence of carbides in the sintered spraying powder should be kept as low as possible. The carbon content of the powder mixture (A) should thus be as low as possible. In an embodiment, the powder mixture (A) can, for example, be essentially free of carbon. For the purposes of the present invention, essentially free of carbon means that the amount of carbon in the powder mixture (A) is below 1% by weight, for example, below 0.1% by weight, for example, below 0.08%, for example, below 0.05% by weight, and, for example, free of carbon, where the percentages by weight are based on the total weight of the powder mixture (A).

In an embodiment of the present invention, the powder mixture (A) can, for example, be essentially free of chromium carbides. For the purposes of the present invention, essentially free of chromium carbides means that the amount of chromium carbides is below 15% by weight, for example, below 1.5% by weight, for example, below 0.8% by weight, for example, below 0.2% by weight, and, for example, free of chromium carbide.

The powder mixture (A) can be produced by simple dry mixing of the powder (B) and the powder (C). Mixing of the powders is for this purpose is usually carried out in mixing apparatuses with which a person skilled in the art will be familiar, in particular, high-speed mixers (high-speed blenders) having high shear forces.

In an embodiment of the process of the present invention, the powder mixture (A) is produced by dispersing the powders (B) and (C) together in a liquid, with the liquid being removed after mixing has been carried out.

Suitable liquids for this purpose have been found to be, in particular, low-boiling liquids, in particular those selected from the group consisting of water, aliphatic alcohols, ketones and any mixtures thereof. The liquids can, for example, be selected from among water, methanol, ethanol and propanol and mixtures thereof.

The subsequent removal of the liquid can be effected by evaporation, for example, with application of a reduced pressure. In an embodiment, the liquid can, for example, be removed by spray drying since agglomerated/sintered spraying powders are obtained at the end of the process.

In an embodiment of the present invention, the dispersion admixed with liquid can, for example, additionally comprise a temporary organic binder as an adhesive which promotes agglomerate formation of the powder and provides a mechanical stability which is sufficient for further processing. Suitable temporary organic binders here are, for example, polyvinyl alcohol (PVA), polyvinylpyrrolidone (PVP), cellulose derivatives, polysaccharides, and acrylic acid polymers.

In step b) of the process of the present invention, sintering, for example, solid-state sintering, of the powder mixture (A) is carried out in a gas atmosphere containing nitrogen with a partial pressure of greater than 1 bar. The conditions of the solid-state sintering (in particular, nitrogen partial pressure and temperature) are, according to the present invention, selected so that formation of or an increase in the amount of or stabilization of chromium nitrides occurs as a result of nitrogen uptake during sintering. A loss of chemically bound nitrogen during sintering of the powder mixture thus does not occur in the process of the present invention, but instead an increase in the chemically bound nitrogen but at least maintaining the chemically bound nitrogen present in the powder mixture occurs.

The presence of nitrogen gas having a partial pressure of >1 bar in the gas atmosphere during sintering is important to the inventive process of the present invention. In an embodiment, the gas atmosphere comprises at least 90% by volume, for example, 95% by volume, for example, at least 98% by volume, and, for example, at least 99.5% by volume, of nitrogen, in each case based on the total volume of the gas atmosphere.

The presence of oxygen is disadvantageous for the process step of sintering, in particular solid-state sintering. The presence of oxygen leads to formation of oxides which adversely affect the property profile of the spraying powders.

It has additionally been found that the absolute pressure of the gas atmosphere during sintering, for example, solid-state sintering, can exert a considerable influence on the formation of chromium nitrides and here especially the formation of CrN. The absolute pressure of the gas atmosphere can therefore be above 1 bar, for example, above 1.5 bar.

Particularly good results can be obtained when sintering, in particular solid-state sintering, is carried out at a nitrogen partial pressure above 6 bar, for example, in the range from 7 to 100 bar, for example, from 8 to 50 bar, and, for example, from 9 to 20 bar. The higher the sintering temperature, the higher the required minimum value for the nitrogen partial pressure.

Sintering, in particular solid-state sintering, is usually carried out at temperatures which promote the formation of sintering necks in the powder mixture. These sintering necks give the sintered agglomerate sufficient mechanical strength, as is necessary for thermal spraying, in particular in HVOF and HVAF spraying processes. Suitable is sintering at temperatures above 1000° C., for example, in the range from 1050° C. to 1500° C., for example, from 1100° C. to 1350° C., and, for example, from 1100° C. to 1250° C.

Solid-state sintering can, for example, be carried out for a time and under conditions so that the sintered spraying powder comprises chromium nitrides, with the amount of CrN being at least 5% by weight, for example, at least 20% by weight, for example, at least 50% by weight, and, for example, at least 80% by weight, in each case based on the total weight of the two chromium nitrides $Cr_2N$ and CrN in the sintered spraying powder. The proportion of the two chromium nitrides is determined by the chromium content of the spraying powder and the nitrogen content of the spraying powder, with a conceivable metallic chromium content in the metallic matrix being disregarded.

Solid-state sintering is usually carried out over a period of at least 1 hour, for example, at least 2 hours, for example, at least 2.5 hours, and, for example, in the range from 3 to 48 hours. Longer times lead, under otherwise identical sintering conditions, to a higher nitrogen uptake.

In an embodiment of the present invention, the process for producing chromium nitride-containing sintered spraying powders can, for example, comprise the following steps:

a) production of a powder mixture (A) comprising, i) a powder (B) comprising $Cr_2N$ powder and optionally CrN, and ii) a powder (C); and b) sintering of the powder mixture (A) in a gas atmosphere containing at least 99.5% by volume of nitrogen at a pressure of the gas atmosphere of above 6 bar and temperatures in the range from 1050° C. to 1400° C.

In an embodiment of the present invention, the process for producing CrN-containing sintered spraying powders can, for example, comprise the following steps:

a) production of a powder mixture (A) comprising, i) a powder (B) comprising chromium powder, and ii) a powder (C); and b) sintering of the powder mixture (A) in a gas atmosphere containing at least 99.5% by volume of nitrogen at a pressure of the gas atmosphere of above 6 bar and temperatures in the range from 1050° C. to 1400° C.

The chromium nitride-containing, sintered spraying powders obtainable by the process of the present invention have excellent properties. In particular, the thermal spraying process makes it possible to form substantially thicker layers.

The present invention further provides a chromium nitride-containing sintered spraying powder which is obtainable by the process of the present invention. The chromium nitride-containing sintered spraying powder can, for example, contain chromium nitride particles having an average diameter of from 1 to 20 μm (e.g., determined electrooptically as number average from image analysis of (electron) micrographs, for instance as a Jeffries diameter).

In an embodiment of the present invention, the sintered spraying powder can, for example, comprise chromium nitride, with CrN being present in an amount of at least 5% by weight, for example, at least 20% by weight, for example, at least 50% by weight, and, for example, at least 80% by weight, in each case based on the total weight of chromium nitride in the sintered spraying powder.

The chromium nitride-containing spraying powders of the present invention are particularly suited for the surface coating of components, for example, friction surfaces.

The present invention therefore further provides a process for producing a surface-coated component by coating of a component by a thermal spraying of the spraying powder of the present invention. Thermal spraying can, for example, be carried out by high-speed flame spraying or plasma spraying. The components obtainable by the coating process have extremely good frictional properties and especially low roughnesses. The component can also be provided with a thicker wear layer as compared to layers which can be conventionally produced by the PVD process.

The present invention therefore further provides a coated component obtainable by the coating process of the present invention. The coated component can, for example, have a wear layer obtained by thermal spraying which has a thickness of at least 15 μm, for example, at least 50 μm, for example, at least 100 μm, for example, at least 200 μm, and, for example, at least 250 μm.

The present invention therefore further provides for the use of the spray powder of the present invention for the surface coating of components.

EXAMPLES

Example 1 (Comparative Example)

CrN+ Ni, Sintering Conventional, $Cr_2N$ Formation 35 kg of chromium nitride containing 15.65% by weight of nitrogen (consisting of CrN having a theoretical nitrogen content of 21.2% by weight and $Cr_2N$ having a theoretical nitrogen content of 12.1% by weight) were screened to a particle size of −10 μm, dispersed in water together with 15 kg of an NiCr 80/20 alloy produced by atomization and spray dried. The granules obtained were screened and sintered at 1000° C. in a carbon crucible in a push-through furnace (pusher-type kiln) customary for sintering spraying powders at a residence time in the heating zone of 3 hours 12 minutes. The furnace atmosphere had a pressure of a few millibar above atmospheric pressure and consisted essentially of hydrogen. This gave an agglomerated/sintered spraying powder having the following properties:

TABLE 1

| Element (Measurement Parameter) (% values are percentages by weight) | Measured Value | Measurement Method |
|---|---|---|
| Nickel (%) | 23.7 | |
| Nitrogen (%) | 7.2 | |
| Oxygen (%) | 0.64 | |
| Carbon (%) | 0.58 | |
| Average particle size (μm) | 31 | Microtrac S3500 |

The expected value for the nitrogen content in the spraying powder would be 70 percent by weight of the nitrogen content of the chromium nitride used (=10.95 percent by weight in the spraying powder) if no decomposition of the chromium nitride used took place. However, the value is actually below the expected value when all of the chromium nitride is present as $Cr_2N$ (=70% of 12.1%=8.47%), which indicates that mainly $Cr_2N$ is present and chromium carbides have additionally been formed (0.58% by weight of carbon were taken up during sintering). Accordingly, only $Cr_2N$ and no CrN was identified in addition to the NiCr phase by means of X-ray diffraction. In the case of conventional sintering of agglomerated/sintered spraying powders, decomposition of the chromium nitrides, in particular of the particularly desirable CrN, into $Cr_2N$ and chromium carbides thus has to be expected.

Example 2 (Comparative Example—Partly Inventive=*)

A spray-dried granulate composed of 70% by weight of chromium nitride powder having a nitrogen content of 11.87% by weight (consisting essentially of $Cr_2N$) and 30% by weight of atomized NiCr 80/20 alloy powder was produced in a manner analogous to Example 1. The spray-dried granulate was sintered in a carbon crucible at various combinations of sintering temperature and nitrogen partial pressure for 3 hours in a pressure sintering furnace (pressure-type sintering furnace), cooled to room temperature under the same pressure, and the nitrogen content of the resulting spraying powders was determined. The nitrogen content of the starting material calculated from the formulation is 8.31%.

TABLE 2

| Temperature (° C.) | Nitrogen Pressure (bar) | Nitrogen (% by weight) | Chromium Nitride Phases according to X-ray Diffraction |
|---|---|---|---|
| 1300 | 5 | 7.64 | $Cr_2N$, little CrN |
| 1300 | 7* | 12.50 | $Cr_2N$, CrN |
| 1300 | 10* | 13.60 | little $Cr_2N$, CrN |
| 1200 | 10* | 13.70 | CrN |

It can clearly be seen that loss or regaining of the nitrogen content takes place at the given temperature as a function of the nitrogen pressure and the proportion of $Cr_2N$ phase can be decreased by means of a suitable choice of the parameters pressure and temperature, while the proportion of particularly desirable CrN phase increases. The proportion of CrN in the chromium nitride component cannot be calculated precisely since it must be expected that the Cr present in the NiCr has likewise formed chromium nitrides to an unknown extent. However, if this effect is disregarded, a proportion of 82% of CrN in the chromium nitride component can be calculated at 1200° C./10 bar nitrogen pressure.

In all cases, a sintered cake was obtained which could be reconverted into a sintered/crushed spraying powder only under the action of mechanical force.

Example 3 (Inventive)

A dispersion in water was produced from 60% chromium nitride powder having a nitrogen content of 14.7% (corresponding to a CrN content of about 29%) and a carbon content of 0.05% and also 40% of finely divided nickel powder (Vale-INCO, Type T255) and a spray-dried granulate was produced from this dispersion. This was sintered at 1150° C. at a nitrogen pressure of 11 bar for 3 hours in a pressure sintering furnace, and the content of nitrogen in the agglomerated/sintered spraying powder was determined. The nitrogen content of the spray-dried granulate calculated from the formulation is 8.82%.

TABLE 3

| Temperature (° C.) | Nitrogen Pressure (bar) | Nitrogen (% by weight) | Chromium Nitride Phases according to X-ray Diffraction |
|---|---|---|---|
| 1150 | 11 | 11.6 | CrN, traces of $Cr_2N$ |

TABLE 4

| Element (Measurement Parameter) (% values are percentages by weight) | Measured value | Measurement Method |
|---|---|---|
| Nickel (%) | 40.4 | |
| Nitrogen (%) | 11.5 | |
| Oxygen (%) | 0.53 | |
| Carbon (%) | 0.19 | |
| Hall flow (s/50 g) | 30 | ASTM B-212 |
| Average particle size (μm) | 38 | Microtrac S3500 |
| Apparent density (g/cm$^3$) | 2.75 | ASTM B-213 |

By sieving, the agglomerated/sintered spraying powder obtained could easily be comminuted to the particle size class from 45 to 15 μm required for HVOF spraying processes since the sintered material was only very loosely sintered. The individual granulates obtained in spray drying had for their part a strength (stability) sufficient for thermal spraying.

It can be seen from the nitrogen content that additional nitrogen was chemically bound during sintering. Taking into account the theoretical nitrogen contents, the proportion of CrN in the chromium nitride component was 79% by weight and that of $Cr_2N$ was 21% by weight. The lower carbon content and chromium carbide content compared to Example 1 is particularly advantageous.

Example 4 (in water was produced from 75% by weight chromium nitride powder having a nitrogen content of 14.7% by weight (corresponding to a CrN content of about 29% by weight) and a carbon content of <0.08% by weight and also 25% of finely divided cobalt powder and a spray-dried granulate was produced from this dispersion. This was sintered at 1150° C. at a nitrogen pressure of 11 bar for 3 hours in a pressure sintering furnace, and the content of nitrogen in the spraying powder was determined. The nitrogen content of the spray-dried granulate calculated from the formulation is 11.0% by weight.

TABLE 5

| Element (Measurement Parameter) (% values are percentages by weight) | Measured value | Measurement Method |
|---|---|---|
| Cobalt (%) | 22.9 | |
| Nitrogen (%) | 14.9 | |
| Oxygen (%) | 0.7 | |
| Carbon (%) | 0.32 | |
| Hall flow (s/50 g) | 35 | ASTM B-212 |
| Average particle size (μm) | 34 | Microtrac S3500 |
| Apparent density (g/cm$^3$) | 2.3 | ASTM B-213 |

By sieving, the agglomerated/sintered spraying powder obtained could easily be comminuted to the required particle size class from 45 to 15 μm since the sintered material was only very loosely sintered together. The individual granulates formed during spray drying themselves had sufficient strength for thermal spraying.

The present invention is not limited to embodiments described herein; reference should be had to the appended claims.

What is claimed is:

1. A process for producing a sintered spraying powder comprising chromium nitride, the process comprising:

producing a powder mixture comprising:

a first powder comprising at least one constituent selected from the group consisting of Cr, CrN and $Cr_2N$, and a second powder comprising at least one constituent selected from the group consisting of nickel, cobalt, nickel alloys, cobalt alloys and iron alloys; and sintering the powder mixture to the sintered spraying powder at a nitrogen partial pressure of >1 bar so as to maintain or increase a chemically bound nitrogen in the sintered spraying powder compared to a chemically bound nitrogen in the first powder mixture.

2. The process as recited in claim 1, wherein the powder mixture comprises at least one of CrN and $Cr_2N$.

3. The process as recited in claim 1, wherein the powder mixture comprises at least one of a nickel powder and a NiCr alloy powder.

4. The process as recited in claim 3, wherein the at least one of a nickel powder and a NiCr alloy powder is a cobalt base alloy, a nickel base alloy, or an iron base alloy.

5. The process as recited in claim 4, wherein the cobalt base alloy, the nickel base alloy, or the iron base alloy comprises at least one constituent selected from the group consisting of Cr, Si, Mo, Ti, Ta, B, Y, W and Mn.

6. The process as recited in claim 1, wherein the producing of the powder mixture comprises:

dispersing the first powder together with the second powder in a liquid; and completing a mixing; and removing the liquid.

7. The process as recited in claim 6, wherein the liquid is selected from the group consisting of water, aliphatic alcohols, ketones, and mixtures thereof.

8. The process as recited in claim 7, wherein the liquid is selected from the group consisting of water, methanol, ethanol, propanol, and mixtures thereof.

9. The process as recited in claim 6, wherein the removing of the liquid is performed by a spray drying.

10. The process as recited in claim 1, wherein the first powder has a particle size D90 of <20 μm.

11. The process as recited in claim 1, wherein the sintering is a solid-state sintering carried out in a gas atmosphere comprising at least 90 volume-% of nitrogen, based on a total volume of the gas atmosphere.

12. The process as recited in claim 1, wherein the sintering is carried out at a nitrogen partial pressure of >6 bar.

13. The process as recited in claim 1, wherein the sintering is carried out at a temperature of >1000° C.

14. The process as recited in claim 1, wherein the sintering is carried out for a period of at least 1 hour.

15. The process as recited in claim 1, wherein the powder mixture is substantially free of chromium carbides.

16. The process as recited in claim 1, wherein the powder mixture comprises the first powder in an amount of from 50 to 90 wt.-%, based on a total weight of the powder mixture.

17. The process as recited in claim 1, wherein the powder mixture comprises the second powder in an amount of from 10 to 50 wt.-%, based on a total weight of the powder mixture.

18. The process as recited in claim 1, wherein the sintered spraying powder comprises chromium nitride, wherein an amount of chromium nitride is at least 50 wt.-%, based on a total weight of chromium nitride in the sintered spraying powder.

19. A sintered spraying powder comprising chromium nitride obtained by the process comprising:

producing a powder mixture comprising:

a first powder comprising at least one constituent selected from the group consisting of Cr, CrN and $Cr_2N$, and a second powder comprising at least one constituent selected from the group consisting of nickel, cobalt, nickel alloys, cobalt alloys and iron alloys; and sintering the powder mixture at a nitrogen partial pressure of >1 bar so as to produce the sintered spraying powder, wherein a chemically bound nitrogen in the sintered spraying powder is increased compared to a chemically bound nitrogen in the powder mixture.

20. A process for producing a surface-coated component, the process comprising:

providing a component;

providing the sintered spraying powder as recited in claim 19; and thermally spraying the component with the sintered spraying powder so as to surface-coat the component.

21. A method of using the sintered spraying powder as recited in claim 19 to surface-coat a component, the process comprising:

providing the component;

providing the sintered spraying powder as recited in claim 19; and thermally spraying the component with the sintered spraying powder so as to surface-coat the component.

22. A coated component obtainable by process comprising:

providing a component;

providing the sintered spraying powder as recited in claim 19; and thermally spraying the component with the sintered spraying powder so as to obtain the coated component.

23. A sintered spraying powder comprising chromium nitride obtained by the process comprising:

producing a powder mixture comprising:

a first powder comprising at least one constituent selected from the group consisting of Cr, CrN and $Cr_2N$, and a second powder comprising at least one constituent selected from the group consisting of nickel, cobalt, nickel alloys, cobalt alloys and iron alloys; and sintering the powder mixture at a nitrogen partial pressure of >1 bar and at a temperature of from >1000 to 1500° C. so as to produce the sintered spraying powder, wherein a chemically bound nitrogen in the sintered spraying powder is increased compared to a chemically bound nitrogen in the powder mixture.

24. A sintered spraying powder comprising chromium nitride obtained by the process comprising:

producing a powder mixture consisting of:

a first powder consisting of at least one constituent selected from the group consisting of Cr, CrN and $Cr_2N$, and a second powder consisting of at least one constituent selected from the group consisting of nickel, cobalt, nickel alloys and cobalt alloys; and sintering the powder mixture at a nitrogen partial pressure of >1 bar so as to produce the sintered spraying powder, wherein a chemically bound nitrogen in the sintered spraying powder is increased compared to a chemically bound nitrogen in the powder mixture.

* * * * *